US010526911B2

(12) United States Patent
Pratt et al.

(10) Patent No.: US 10,526,911 B2
(45) Date of Patent: Jan. 7, 2020

(54) SPLIT SYNCHRONIZATION RING FOR VARIABLE VANE ASSEMBLY

(71) Applicant: UNITED TECHNOLOGIES CORPORATION, Farmington, CT (US)

(72) Inventors: William S. Pratt, West Hartford, CT (US); David Maliniak, Guilford, CT (US); Christopher St. Mary, Hebron, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 199 days.

(21) Appl. No.: 15/630,650

(22) Filed: Jun. 22, 2017

(65) Prior Publication Data

US 2018/0371937 A1 Dec. 27, 2018

(51) Int. Cl.

| | |
|---|---|
| ***F01D 17/00*** | (2006.01) |
| ***F01D 17/16*** | (2006.01) |
| ***F01D 9/04*** | (2006.01) |
| ***F01D 25/24*** | (2006.01) |
| ***F04D 29/56*** | (2006.01) |

(52) U.S. Cl.

CPC ..... *F01D 17/162* (2013.01); *F01D 9/041* (2013.01); *F01D 25/246* (2013.01); *F04D 29/563* (2013.01); *F05D 2220/32* (2013.01); *F05D 2230/60* (2013.01); *F05D 2260/50* (2013.01)

(58) Field of Classification Search

CPC ... F01D 17/16; F05D 2260/50; F05D 2230/60
See application file for complete search history.

(56) References Cited

U.S. PATENT DOCUMENTS

| | | | | |
|---|---|---|---|---|
| 3,314,654 | A * | 4/1967 | Georges | F01D 17/162 415/160 |
| 3,608,860 | A * | 9/1971 | Horn | F03B 3/183 251/79 |
| 4,773,821 | A * | 9/1988 | Gonthier | F01D 17/162 415/150 |
| 4,792,277 | A * | 12/1988 | Dittberner, Jr. | F01D 11/001 415/160 |
| 4,834,613 | A * | 5/1989 | Hansen | F01D 17/162 415/160 |
| 4,990,056 | A | 2/1991 | McClain et al. | |

(Continued)

FOREIGN PATENT DOCUMENTS

| | | | |
|---|---|---|---|
| GB | 2412946 | A | 10/2005 |
| WO | WO2016010764 | A1 | 1/2016 |

OTHER PUBLICATIONS

European Patent Office, European Search Report dated Feb. 4, 2019 in Application No. 18168256.8.

*Primary Examiner* — Hieu T Vo
*Assistant Examiner* — Sherman D Manley
(74) *Attorney, Agent, or Firm* — Snell & Wilmer L.L.P.

(57) ABSTRACT

A synchronization ring for a variable vane assembly of a gas turbine engine may include a first ring portion and a second ring portion. The first ring portion and the second ring portion may be detachably coupled together to jointly define a plurality of cylindrical bores circumferentially distributed around the synchronization ring and extending radially through the synchronization ring.

14 Claims, 11 Drawing Sheets

(56) References Cited

U.S. PATENT DOCUMENTS 5,061,152 A * 10/1991 Marey ..... F01D 17/162 415/150
5,277,544 A * 1/1994 Naudet ..... F04D 29/563 415/160
5,421,703 A * 6/1995 Payling ..... F01D 9/042 415/209.3
5,472,314 A * 12/1995 Delonge ..... F01D 5/148 415/115
6,086,327 A * 7/2000 Mack ..... F01D 17/162 384/273
6,790,000 B2 * 9/2004 Wolf ..... F01D 17/162 415/165
7,448,848 B2 11/2008 Alexander et al.
7,510,369 B2 * 3/2009 Lytle ..... F01D 17/162 29/889.22
7,713,022 B2 * 5/2010 Major ..... F01D 17/162 29/889.22
7,901,178 B2 3/2011 Giaimo et al.
7,938,620 B2 5/2011 Bouru
8,226,357 B2 7/2012 Bouru et al.
8,500,394 B2 * 8/2013 Major ..... F01D 17/162 415/160
8,668,443 B2 3/2014 Espasa et al.
9,422,825 B2 8/2016 Do
9,926,944 B2 * 3/2018 Mouton ..... F01D 17/162
2006/0285969 A1 * 12/2006 Maurice Ribassin ... F01D 17/16 415/160
2011/0176913 A1 * 7/2011 Wassynger ..... F01D 17/162 415/159
2012/0257963 A1 * 10/2012 Major ..... F01D 17/162 415/182.1
2013/0129487 A1 * 5/2013 Colette ..... F01D 17/162 415/148
2014/0234085 A1 * 8/2014 Maliniak ..... F04D 29/563 415/159
2015/0354387 A1 * 12/2015 Maliniak ..... F01D 17/162 415/1
2016/0032759 A1 2/2016 Gasmen et al.
2016/0115875 A1 * 4/2016 Benderradji ..... F01D 17/162 415/148
2016/0208637 A1 * 7/2016 Maliniak ..... F01D 17/162

* cited by examiner

SPLIT SYNCHRONIZATION RING FOR VARIABLE VANE ASSEMBLY

GOVERNMENT LICENSE RIGHTS

This disclosure was made with government support under Contract No. FA8626-16-C-2139 awarded by the U.S. Air Force. The government has certain rights in the disclosure.

FIELD

The present disclosure relates to gas turbine engines, and more specifically, to synchronization rings for variable vane assemblies of gas turbine engines.

BACKGROUND

A gas turbine engine typically includes a fan section, a compressor section, a combustor section, and a turbine section. Certain sections of gas turbine engines, such as the compressor section, include a plurality of vanes for directing air and/or combustion gases. Variable vane assemblies have been utilized in gas turbine engines to change the pitch of the vanes. Conventional variable vane assemblies utilize a synchronization ring and vane arms coupled to the vanes to synchronize adjustments made to the pitch of the vanes. However, many conventional variable vane assemblies have complex and time-intensive assembly methods. Further, replacing or repairing a single vane in certain assemblies may involve disconnecting all of the vanes from a conventional synchronization ring.

SUMMARY

In various embodiments, the present disclosure provides a synchronization ring for a variable vane assembly of a gas turbine engine. The synchronization ring may include a first ring portion and a second ring portion. The first ring portion and the second ring portion are detachably coupled together to jointly define a plurality of cylindrical bores circumferentially distributed around the synchronization ring and extending radially through the synchronization ring, according to various embodiments.

In various embodiments, the first ring portion defines a plurality of first semi-cylindrical bores circumferentially distributed around the first ring portion and extending radially through the first ring portion. In various embodiments, the second ring portion defines a plurality of second semi-cylindrical bores circumferentially distributed around the second ring portion and extending radially through the second ring portion. In various embodiments, the plurality of first semi-cylindrical bores are circumferentially aligned with the plurality of second semi-cylindrical bores to jointly define the plurality of cylindrical bores.

According to various embodiments, the first ring portion includes a plurality of first arcuate segments circumferentially coupled together. In various embodiments, the second ring portion includes a plurality of second arcuate segments circumferentially coupled together. A first interface between first adjacent arcuate segments of the plurality of first arcuate segments may be circumferentially misaligned with a second interface between second adjacent arcuate segments of the plurality of second arcuate segments. In various embodiments, the plurality of first arcuate segments includes a first quantity of arcuate segments and the plurality of second arcuate segments includes a second quantity of arcuate segments, wherein the first quantity is different than the second quantity. For example, the first ring portion may be a forward ring portion that has fewer segments than the second ring portion, which may be an aft ring portion.

Also disclosed herein, according to various embodiments, is a gas turbine engine. The gas turbine engine includes a case and a synchronization ring. The synchronization ring may be disposed radially outward of the case and may be configured to circumferentially rotate relative to the case. The synchronization ring may include a forward ring portion and an aft ring portion detachably coupled together, wherein the forward ring portion and the aft ring portion jointly define a plurality of cylindrical bores circumferentially distributed around the synchronization ring and extending radially through the synchronization ring. The case may be a compressor case.

In various embodiments, the case defines a plurality of vane stem slots circumferentially distributed around the case and extending radially through the case. The gas turbine engine may further include a vane, a vane arm, and a pin. The vane may include a vane body and a vane stem, wherein the vane body is disposed on a radially inward side of the case and the vane stem extends radially outward through one of the plurality of vane stem slots. The vane arm may include a first end and a second end, wherein the first end is coupled to a radially outward end of the vane stem, the vane arm extending substantially perpendicular to the vane stem. The pin may be coupled to the second end of the vane arm and the pin may extend radially through one of the plurality of cylindrical bores.

In various embodiments, the first end of the vane arm includes a dovetail-type cavity and the radially outward end of the vane stem includes a complementary dovetail-type protrusion. In various embodiments, the pin is at least one of rotatably coupled to the second end of the vane arm and rotatable within the one of the plurality of cylindrical bores.

In various embodiments, the vane is a first vane, the vane body is first vane body, the vane stem is a first vane stem, the radially outward end is a first radially outward end, the vane arm is a first vane arm, and the pin is a first pin. In such embodiments, the gas turbine engine further includes a second vane, a second vane arm, and a second pin. The second vane may have a second vane body and a second vane stem, wherein the second vane body is disposed on a radially inward side of the case and the second vane stem extends radially outward through one of the plurality of vane stem slots. The second vane arm may include a third end and a fourth end, wherein the third end is coupled to a second radially outward end of the second vane stem, the second vane arm extending substantially perpendicular to the second vane stem. The second pin may be coupled to the fourth end of the second vane arm, the second pin extending radially, wherein the second pin extends radially through one of the plurality of cylindrical bores. In various embodiments, the first pin extends radially inward from the second end of the first vane arm and the second pin extends radially outward from the fourth end of the second vane arm.

Also disclosed herein, according to various embodiments, is a method of assembling a gas turbine engine. The method may include inserting a vane stem of a vane radially outward through a vane stem slot of a case and coupling a first end of a vane arm to a radially outward end of the vane stem, wherein a pin is coupled to a second end of the vane arm. The method may further include positioning a forward ring portion of a synchronization ring forward of the pin and positioning an aft ring portion of the synchronization ring aft of the pin. Still further, the method may include coupling the forward ring portion to the aft ring portion, wherein the forward ring portion and the aft ring portion jointly define a cylindrical bore around the pin.

In various embodiments, coupling the first end of the vane arm to the radially outward end of the vane stem includes relative axial movement between the vane arm and the radially outward end of the vane stem. For example, the first end of the vane arm may include a dovetail-type cavity and the radially outward end of the vane stem may include a complementary dovetail-type protrusion, wherein coupling the first end of the vane arm to the radially outward end of the vane stem includes axially inserting the dovetail-type protrusion into the dovetail-type cavity. In various embodiments, the method further includes individually removing the vane for at least one of replacement and repair, wherein individually removing the vane includes decoupling at least a local arcuate segment of the aft ring portion from the forward ring portion and decoupling the first end of the vane arm from the radially outward end of the vane stem via relative axial movement between the vane arm and the radially outward end of the vane stem.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
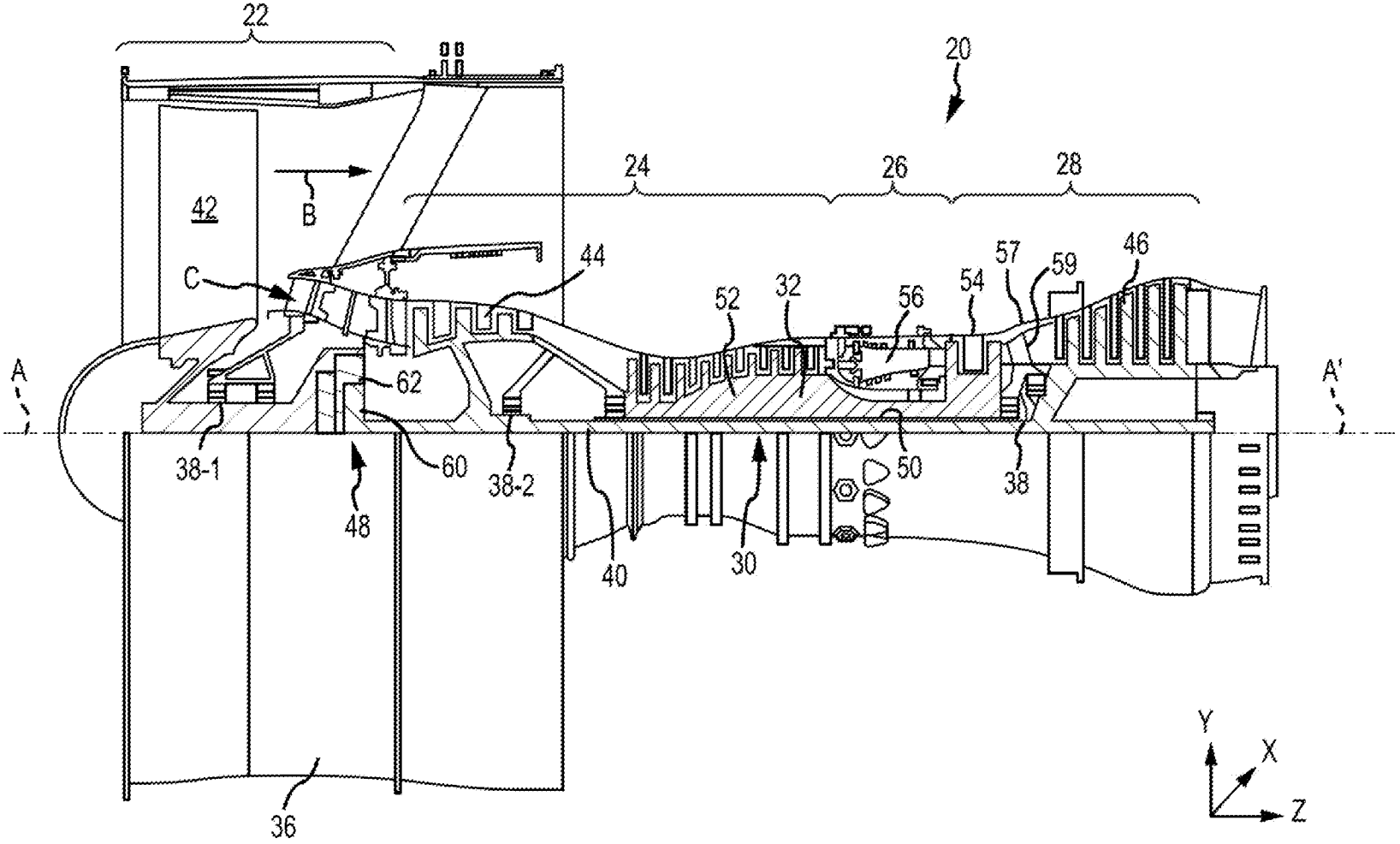
FIG. 1 illustrates a cross-sectional view of an exemplary gas turbine engine, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

As used herein, "aft" refers to the direction associated with the exhaust (e.g., the back end) of a gas turbine engine. As used herein, "forward" refers to the direction associated with the intake (e.g., the front end) of a gas turbine engine.

A first component that is "radially outward" of a second component means that the first component is positioned at a greater distance away from the engine central longitudinal axis than the second component. A first component that is "radially inward" of a second component means that the first component is positioned closer to the engine central longitudinal axis than the second component. In the case of components that rotate circumferentially about the engine central longitudinal axis, a first component that is radially inward of a second component rotates through a circumferentially shorter path than the second component. The terminology "radially outward" and "radially inward" may also be used relative to references other than the engine central longitudinal axis. For example, a first component of a combustor that is radially inward or radially outward of a second component of a combustor is positioned relative to the central longitudinal axis of the combustor. The term "axial," as used herein, refers to a direction along or parallel to the engine central longitudinal axis.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive fluid (e.g., air) along a bypass flow-path B while compressor section 24 can drive fluid along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of turbine engines including three-spool architectures.

Gas turbine engine 20 may generally comprise a low speed spool 30 and a high speed spool 32 mounted for rotation about an engine central longitudinal axis A-A' relative to an engine static structure 36 or engine case via several bearing systems 38, 38-1, and 38-2. Engine central longitudinal axis A-A' is oriented in the z direction on the provided xyz axis. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor 44 and a low pressure turbine 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54.

A combustor 56 may be located between high pressure compressor 52 and high pressure turbine 54. The combustor section 26 may have an annular wall assembly having inner and outer shells that support respective inner and outer heat shielding liners. The heat shield liners may include a plurality of combustor panels that collectively define the annular combustion chamber of the combustor 56. An annular cooling cavity is defined between the respective shells and combustor panels for supplying cooling air. Impingement holes are located in the shell to supply the cooling air from an outer air plenum and into the annular cooling cavity.

A mid-turbine frame 57 of engine static structure 36 may be located generally between high pressure turbine 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans. A gas turbine engine may comprise an industrial gas turbine (IGT) or a geared aircraft engine, such as a geared turbofan, or non-geared aircraft engine, such as a turbofan, or may comprise any gas turbine engine as desired.

Figure 2:
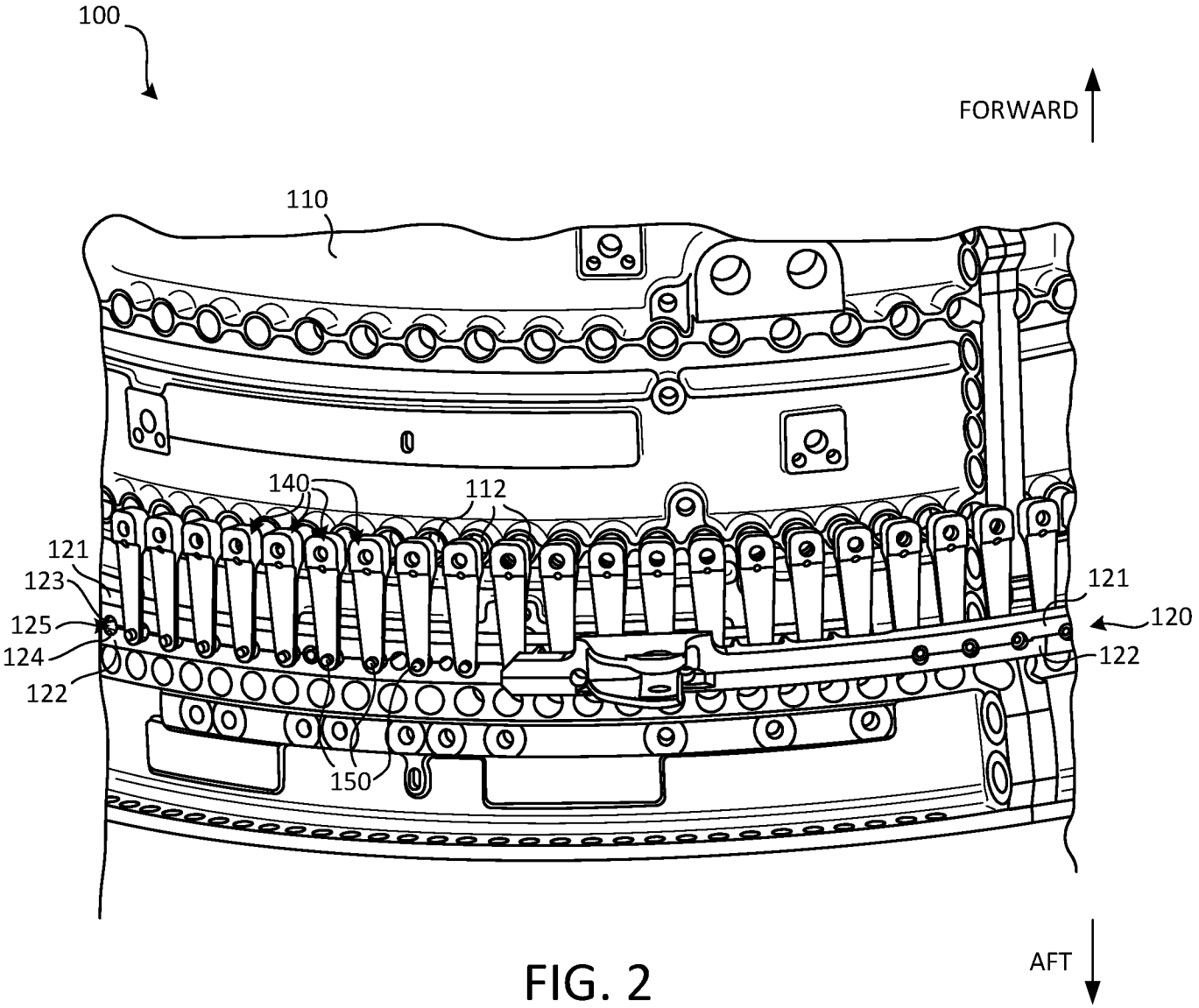
FIG. 2 illustrates a perspective view of a variable vane assembly having a synchronization ring split into axial portions, in accordance with various embodiments.

In various embodiments, and with reference to FIG. 2, the present disclosure provides a synchronization ring 120 of a variable vane assembly 100 that includes two axial portions. The synchronization ring 120 includes a first ring portion 121 and a second ring portion 122 that are detachably coupled together to jointly define a plurality of cylindrical bores 125 of the synchronization ring 120, according to various embodiments. Said differently, the first ring portion 121 may be a forward ring portion and the second ring portion 122 may be an aft ring portion (e.g., two separable axial halves that jointly form the synchronization ring 120).

Synchronization rings are generally utilized in variable vane assemblies to link a plurality of vanes to an actuator. Thus, one or more actuators may be mechanically coupled to the synchronization ring 120, which is mechanically coupled to vane stems 134 of a plurality of vanes (with momentary reference to FIGS. 3 and 4) via a corresponding plurality of vane arms 140. Therefore, in response to actuating the actuator(s), the synchronization ring 120 rotates around and relative to, for example, a compressor case 110, thereby causing the pitch of all of the vanes to be simultaneously adjusted.

As described above, conventional variable vane assemblies have various shortcomings, particularly pertaining to their associated methods of assembly and repair. In various embodiments, the split synchronization ring 120 of the variable vane assembly 100 overcomes these shortcomings, as described in greater detail below.

In various embodiments, and with continued reference to FIG. 2, the first ring portion 121 defines a plurality of first semi-cylindrical bores 123 that are circumferentially distributed around the first ring portion 121 and that extend radially through the first ring portion 121. The second ring portion 122 defines a plurality of second semi-cylindrical bores 124 that are circumferentially distributed around the second ring portion 122 and that extend radially through the second ring portion 122, according to various embodiments. The plurality of first semi-cylindrical bores 123 may be circumferentially aligned with the plurality of second semi-cylindrical bores 124 to jointly define the plurality of cylindrical bores 125.

Figure 3:
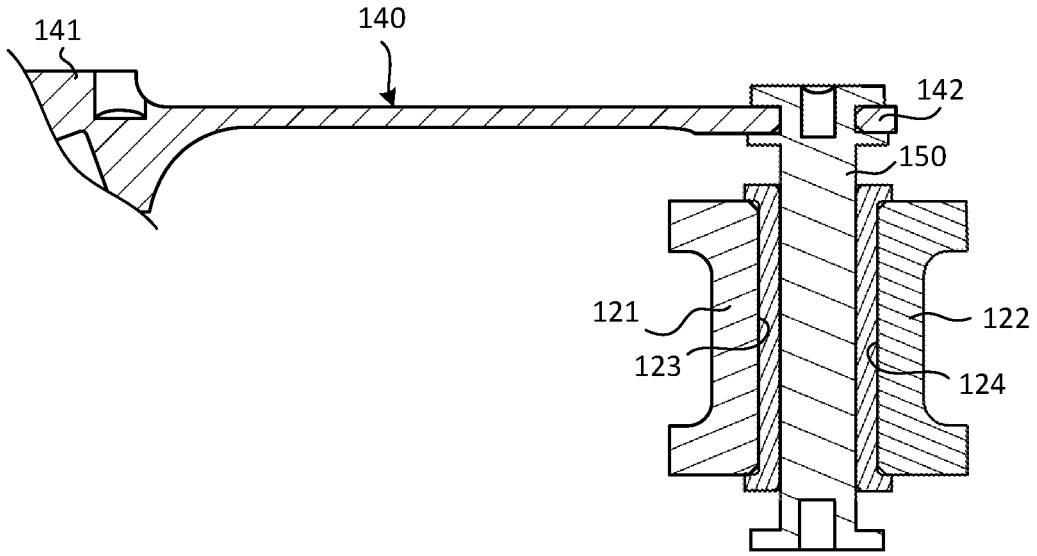
FIG. 3 illustrates a cross-sectional view of a variable vane assembly, in accordance with various embodiments.
Figure 4:
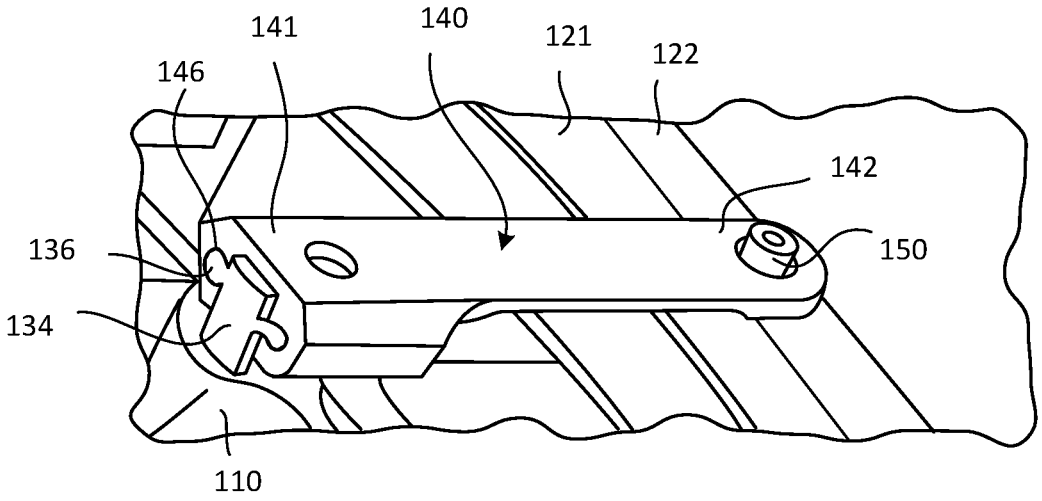
FIG. 4 illustrates a perspective view of an attachment configuration of a vane stem and a vane arm, in accordance with various embodiments.

In various embodiments, and with reference to FIGS. 2, 3, and 4, the case 110, around which the synchronization ring 120 is situated, defines a plurality of vane stem slots 112 that are circumferentially distributed around the case 110 and that extend radially through the case 110. The gas turbine engine 20 may include a plurality of vanes. Each vane may include a vane body and a vane stem 134, according to various embodiments. The vane body may disposed on a radially inward side of the case 110 and the vane stem 134 may extend radially outward through one of the plurality of vane stem slots 112.

In FIG. 2 the radially outward surface of the case 110 is shown. Accordingly, a radially outward end of a vane stem 134 protrudes from the vane stem slots 112 defined in the case 110, and this radially outward end of the vane stem 134 is coupled to a vane arm 140, according to various embodiments. The vane arm 140 may include a first end 141 and a second end 142. The radially outward end of the vane stem 134 may be coupled to the first end 141, and a radially extending pin 150 may be coupled to the second end 142. In various embodiments, the vane arm 140 extends substantially perpendicular to the vane stem 134 (e.g., perpendicular to the radial direction). As used herein, "substantially perpendicular" means within five degrees of perpendicular. In various embodiments, the pin 150 extends radially through one of the plurality of cylindrical bores 125 that is jointly formed by the first and second ring portions 121, 122. As mentioned above, because the first and second ring portions 121, 122 are detachably coupled together (e.g., via bolts), these ring portions 121, 122 may be disconnected from each other to allow more freedom during assembly of the gas turbine engine 20, as described in greater detail below with reference to FIGS. 6, 7A, 7B, 7C, 7D, 7E, and 7F.

In various embodiments, and with reference to FIG. 4, the first end 141 of the vane arm 140 has a dovetail-type cavity 146, and the radially outward end of the vane stem 134 includes a complementary dovetail-type protrusion 136. In other words, the engagement between the first end 141 of the vane arm 140 and the vane stem 134 may be configured to reinforce against radial movement of the vane. The dovetail-type connection may prevent the vane from moving radially relative to the vane arm 140. Thus, coupling the first end 141 of the vane arm 140 to the radially outward end of the vane stem 134 may involve axial movement between the vane arm 140 and the vane stem 134 (i.e., coupling the first end 141 of the vane arm 140 to the vane stem 134 may include inserting the dovetail-type protrusion 136 in an axial direction into the dovetail-type cavity 146). Because of the detachable nature of the first and second ring portions 121, 122, the position of the vane arms 140 may be individually adjusted, thus improving the ease of assembly and repair. In other words, the first ring portion 121 may be detached from the second ring portion 122, thus allowing individual vane arms 140 to be axially moved and adjusted to individually engage the vane arms 140 to respective vane stems 134.

In various embodiments, the pin 150 is at least one of rotatably coupled to the second end 142 of the vane arm 140 or rotatable within the one of the plurality of cylindrical bores 125. Said differently, the pin 150 may be coupled in rotatable engagement with the second end 142 of the vane arm 140 and/or the pin 150 may extend through a cylindrical bore 125 jointly formed by the first and second ring portions 121, 122. In various embodiments, the pin 150 may be preassembled attached to the vane arm 140 (i.e., the pin 150 may be permanently coupled to the vane arm 140, such that separating the pin 150 from the vane arm 140 would damage at least one of the pin 150 or the vane arm 140). Additional details pertaining to methods of assembly and repair are included below with reference to FIGS. 6, 7A, 7B, 7C, 7D, 7E, and 7F.

Figure 5A:
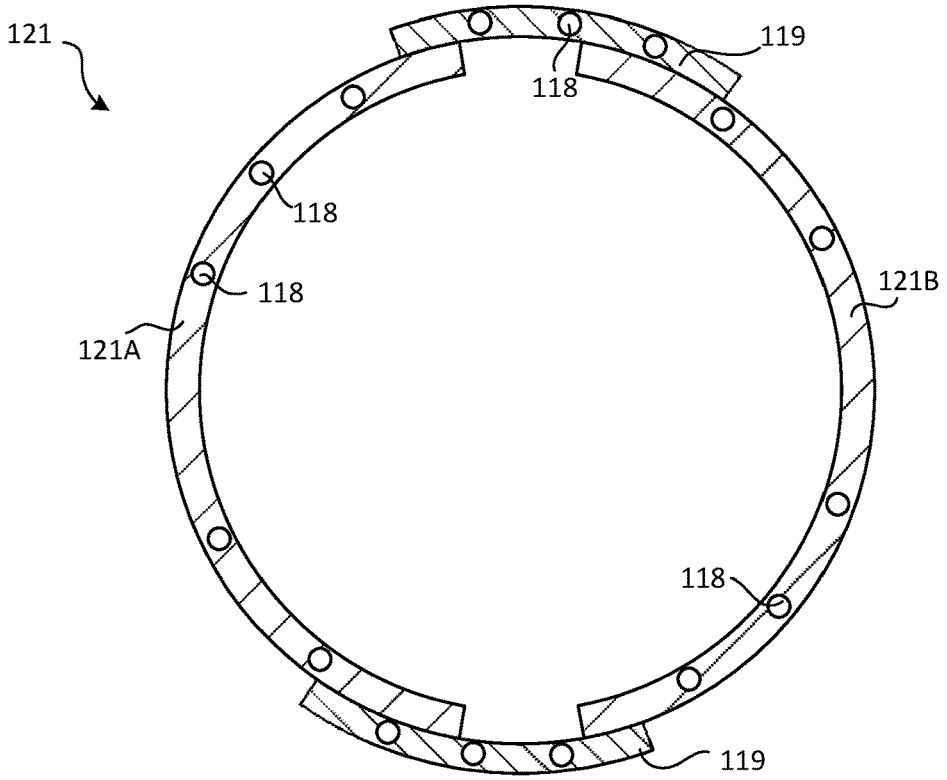
FIGS. 5A and 5B illustrate cross-sectional views of a first ring portion and second ring portion of a synchronization ring, in accordance with various embodiments.
Figure 5B:
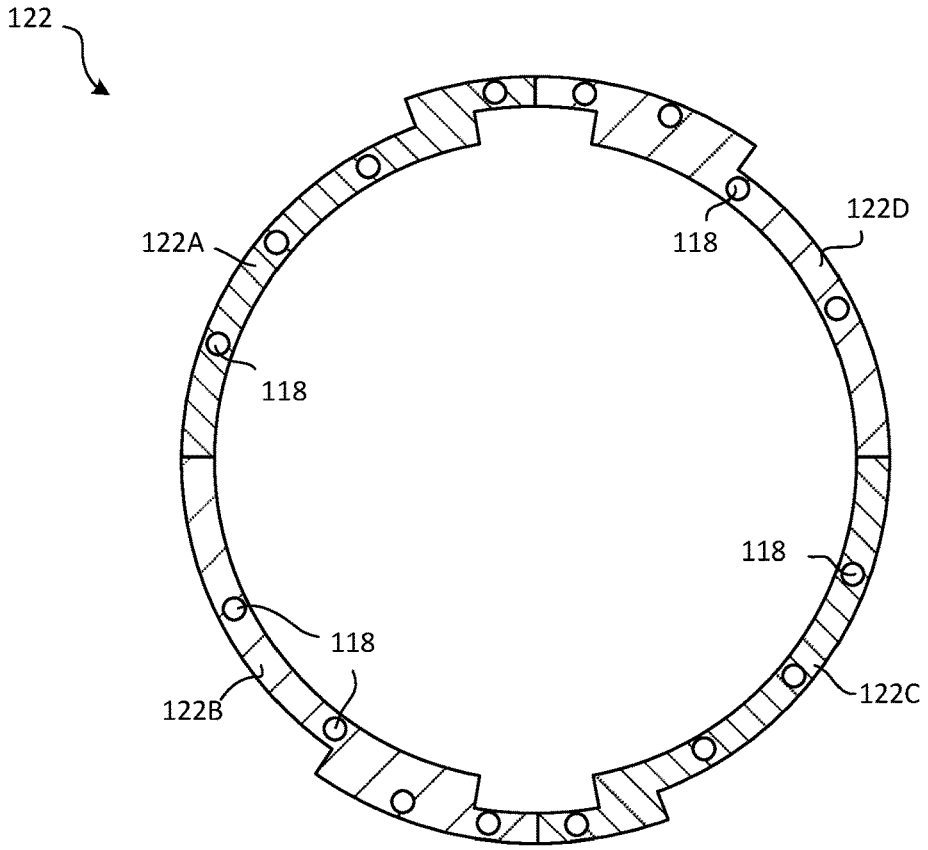

In various embodiments, and with reference to FIGS. 5A and 5B, the ring portions 121, 122 of the synchronization ring 120 are formed of a plurality of arcuate segments. Said differently, the first ring portion 121 may include a plurality of first arcuate segments 121A, 121B that are circumferentially coupled together. The ring portions 121, 122 may include a clevis 119 that mechanically links arcuate segments 121A, 121B together. The ring portions 121, 122 may also include attachment interfaces 118, such as bolt holes or the like, for axially connecting the ring portions 121, 122 together. The second ring portion 122 may also include a plurality of second arcuate segments 122A, 122B, 122C, 122D that are circumferentially coupled together.

In various embodiments, a first interface/joint between first adjacent arcuate segments of the plurality of first arcuate segments 121A, 121B is configured to be circumferentially misaligned with a second interface/joint between second adjacent arcuate segments of the plurality of second arcuate segments 122A, 122B. In various embodiments, the first ring portion 121 is comprised of a first quantity of first arcuate segments 121A, 121B, and the second ring portion 122 is comprised of a second quantity of second arcuate segments 122A, 122B, 122C, 122D. In various embodiments, the first quantity is different than the second quantity. For example, the first quantity may be less than the second quantity (i.e., the second ring portion 122 or aft ring portion may be divided into more arcuate segments than the first ring portion 121).

Figure 6:
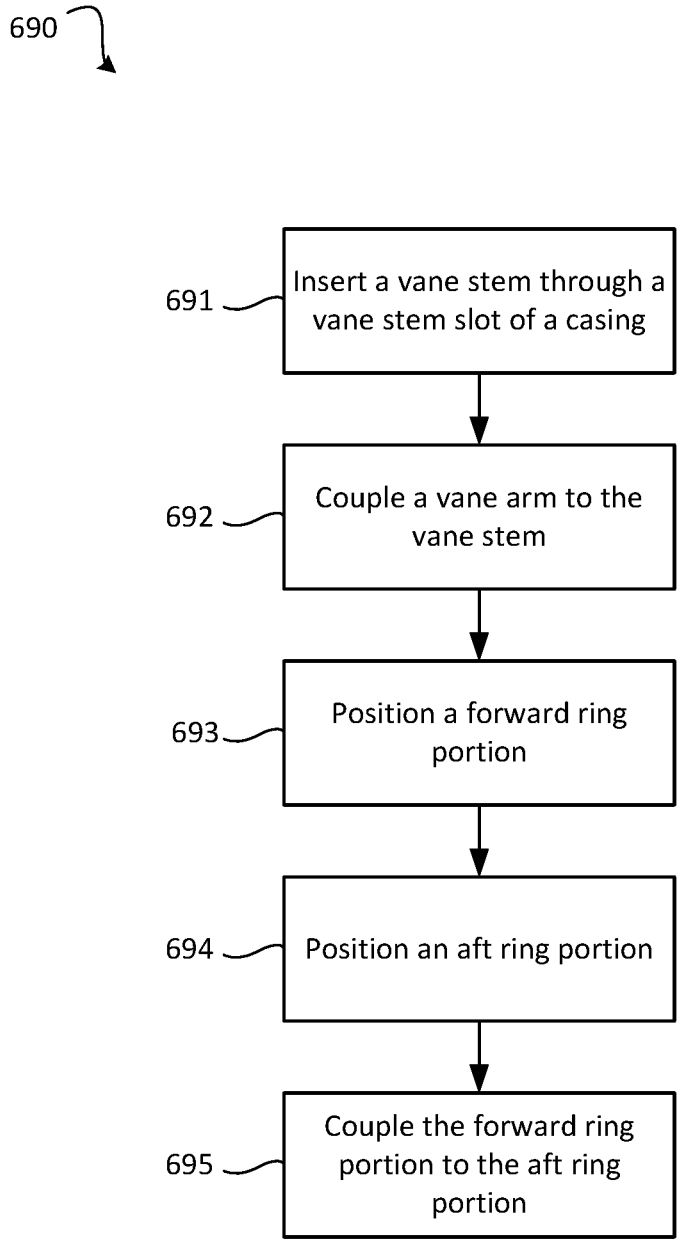
FIG. 6 is a schematic flowchart diagram of a method of assembling a gas turbine engine, in accordance with various embodiments.

In various embodiments, and with reference to FIG. 6, a method 690 of assembling the gas turbine engine 20 is provided. The method 690 includes inserting the vane stem 134 through the vane stem slot 112 of the case 110 at step 691, according to various embodiments. The method 690 may further include coupling the vane arm 140 (e.g., the first end 141 of the vane arm 140) to a radially outward end of the vane stem 134 at step 692 and positioning the first and second ring portions 121, 122 at steps 693 and 694 respectively. Said differently, the first ring portion 121, which may be a forward ring portion, may be positioned forward of the pin 150 at step 693, and the second ring portion 122, which may be an aft ring portion, may be positioned aft of the pin 150 at step 694. The method 690 may further include coupling the first ring portion 121 to the second ring portion 122 to jointly define the cylindrical bore 125 around the pin 150.

Figure 7A:
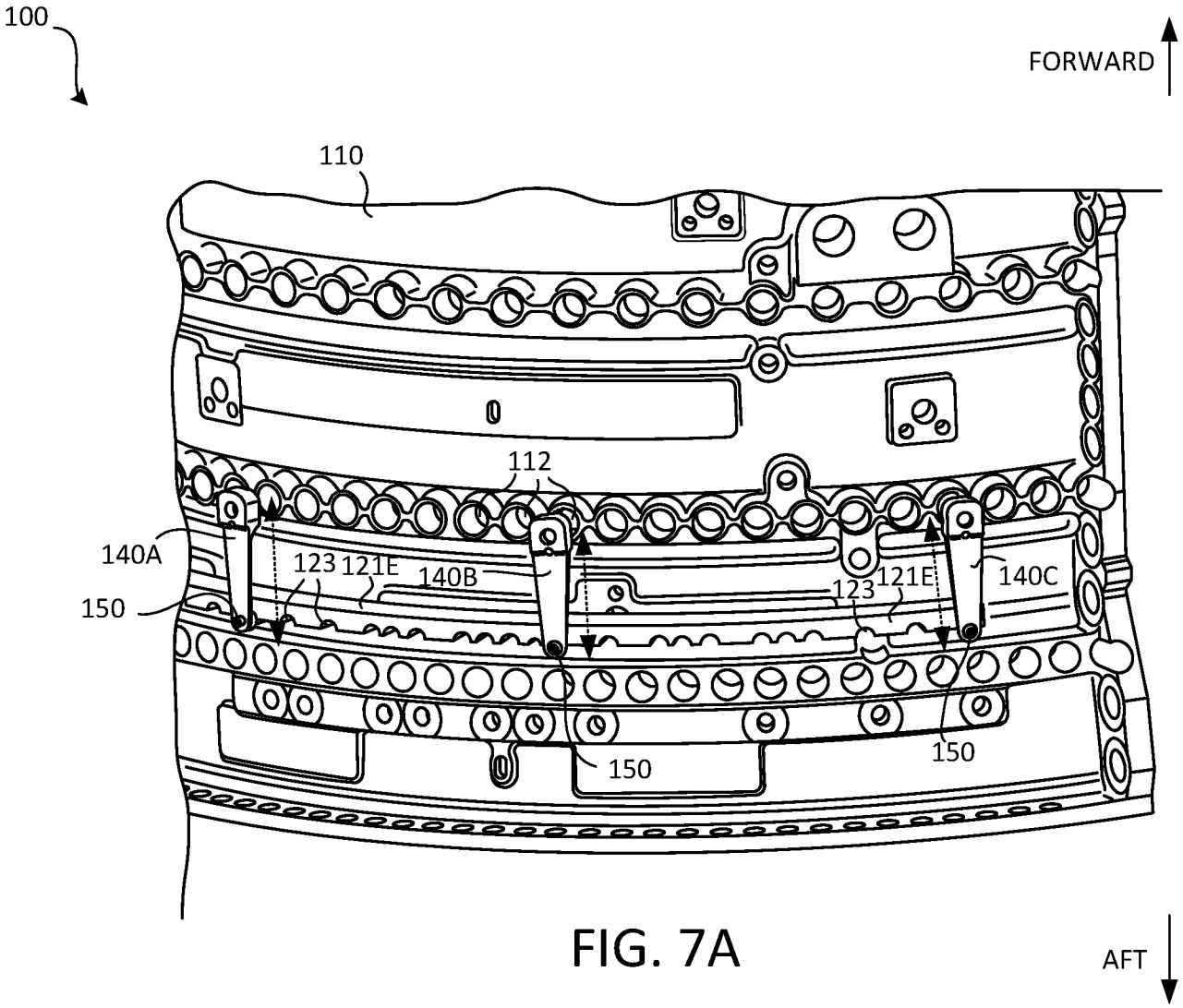
FIGS. 7A, 7B, 7C, 7D, 7E, and 7F illustrate perspective views of a variable vane assembly in various stages of assembly, in accordance with various embodiments.
Figure 7B:
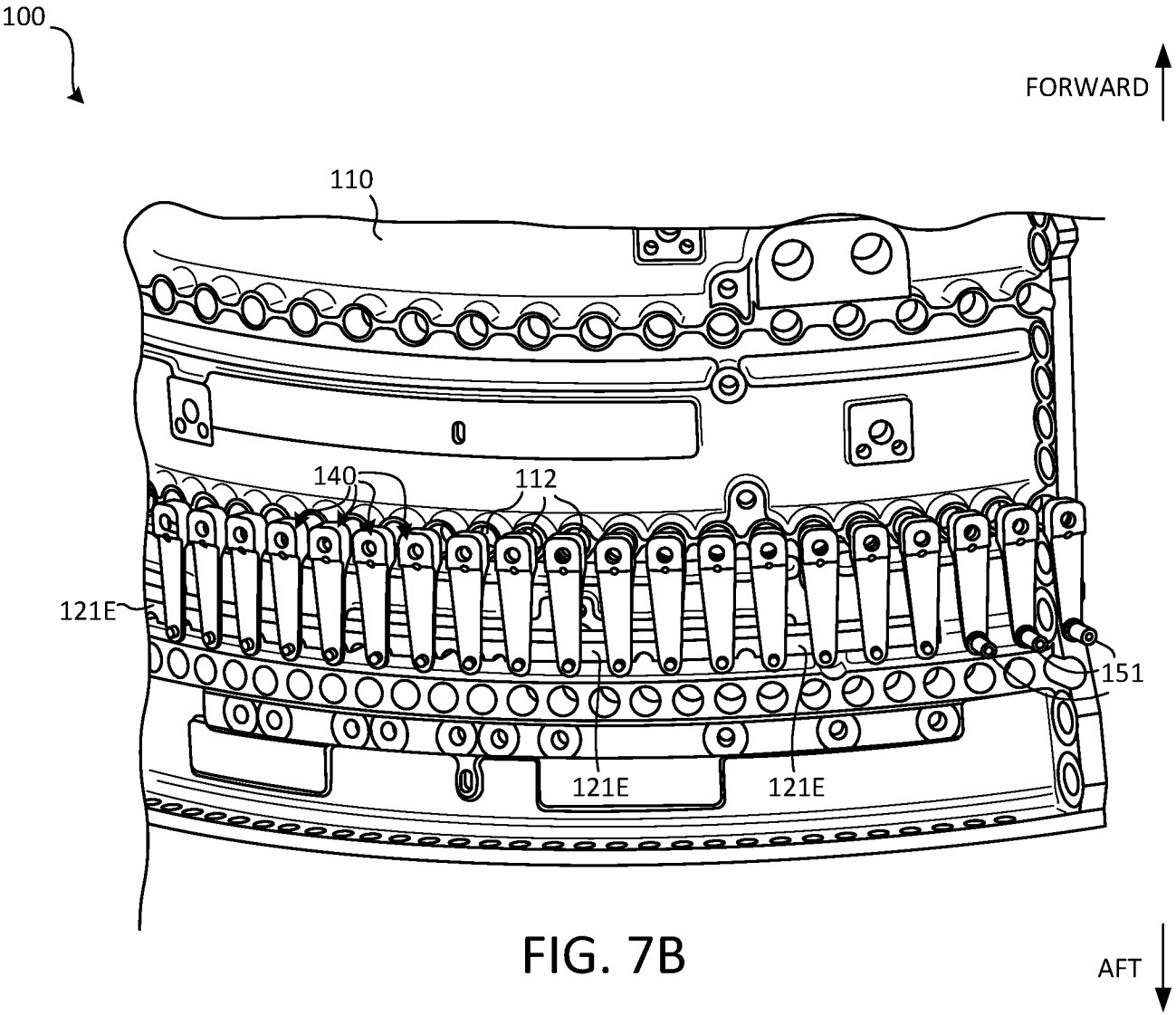

In various embodiments, and with reference to FIG. 7A, steps 692 and 693 of the method 690 of assembling the gas turbine engine 20 include coupling several (of many) vane arms 140A, 140B, 140C to respective vane stems and positioning the first/forward ring portion 121E forward of the pins 150. In various embodiments, and with reference to FIG. 7B, the remaining vane arms 140 are coupled to respective vane stems. At this stage of the assembly, because only the forward ring portion 121E is in position, the vane arms 140 can be individually moved axially, thus allowing axial engagement features, such as the aforementioned dovetail-type protrusion 136 and dovetail-type cavity 146, to be individually axially engaged. In various embodiments, and with continued reference to FIG. 7B, some of the vane arms may include pins 151 that extend radially outward (i.e., away from the case 110). These outwardly extending pins 151 are described in greater detail below with reference to FIG. 7D.

Figure 7C:
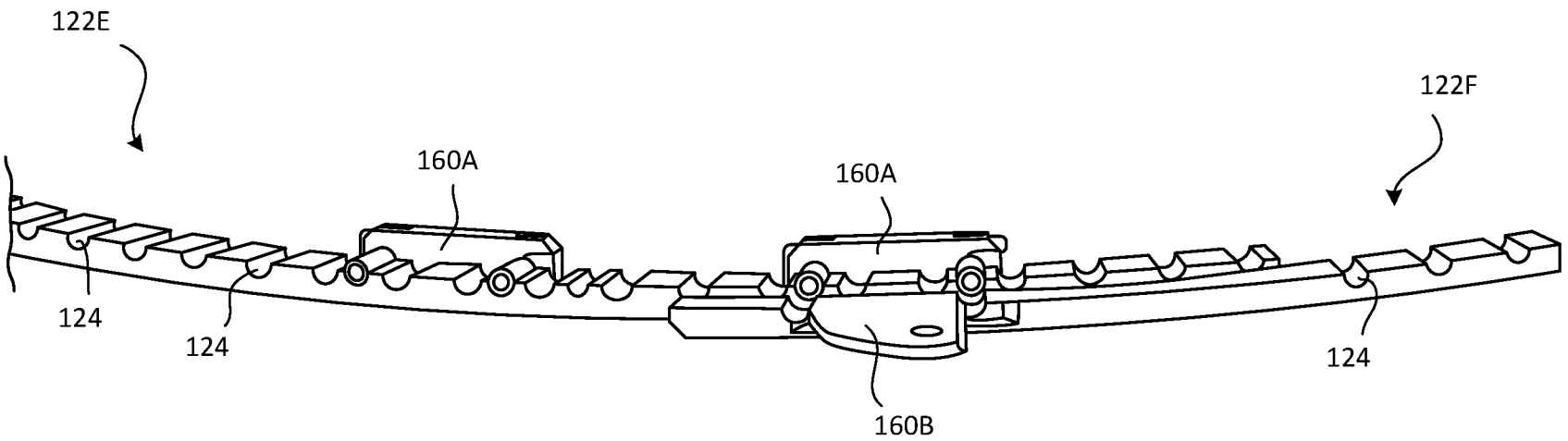
Figure 7D:
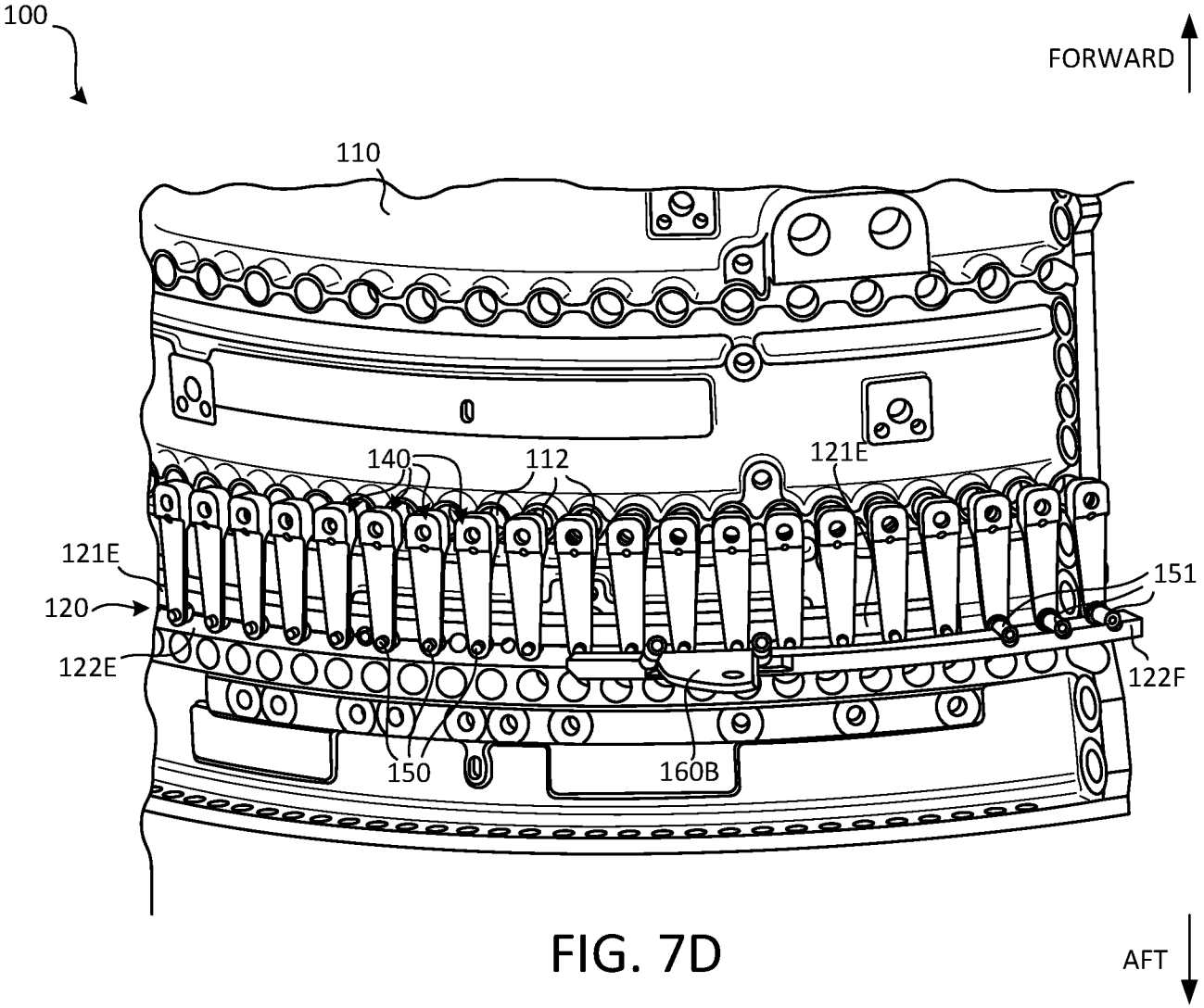

In various embodiments, and with reference to FIGS. 7C and 7D, steps 694 and 695 of the method 690 include positioning the second/aft ring portion 122E aft of the pins 150 and coupling the forward ring portion 121E to the aft ring portion 122E. Before performing steps 694 and 695, one or more additional components may be disposed between the two ring portions 121E, 122E. For example, a bracket 160A that facilitates engagement of the synchronization ring 120 with the radially outward surface of the case 110 may be mounted between the two ring portions 121E, 122E. In another example, an actuator interface 160B may be similarly disposed between the two ring portions 121E, 122E. The actuator interface 160B may be a location where the drive actuator of the variable vane assembly 100 mechanically links to the synchronization ring 120 for driving rotation of the synchronization ring 120 about the case 110.

As mentioned above, the forward and aft ring portions 121E, 122E may be comprised of multiple arcuate segments. Accordingly, the method of assembling the gas turbine engine may further include individual positioning arcuate sections of the ring portions relative to the pins. Said differently, and with reference to FIG. 7D, arcuate segment 122F may be a section of the aft ring portion and may be positioned aft of the radially outward extending pins 151. Similarly, and with reference to FIG. 7F, arcuate segment 121F may be a section of the forward ring portion and may be positioned forward of the radially outward extending pins 151.

Figure 7E:
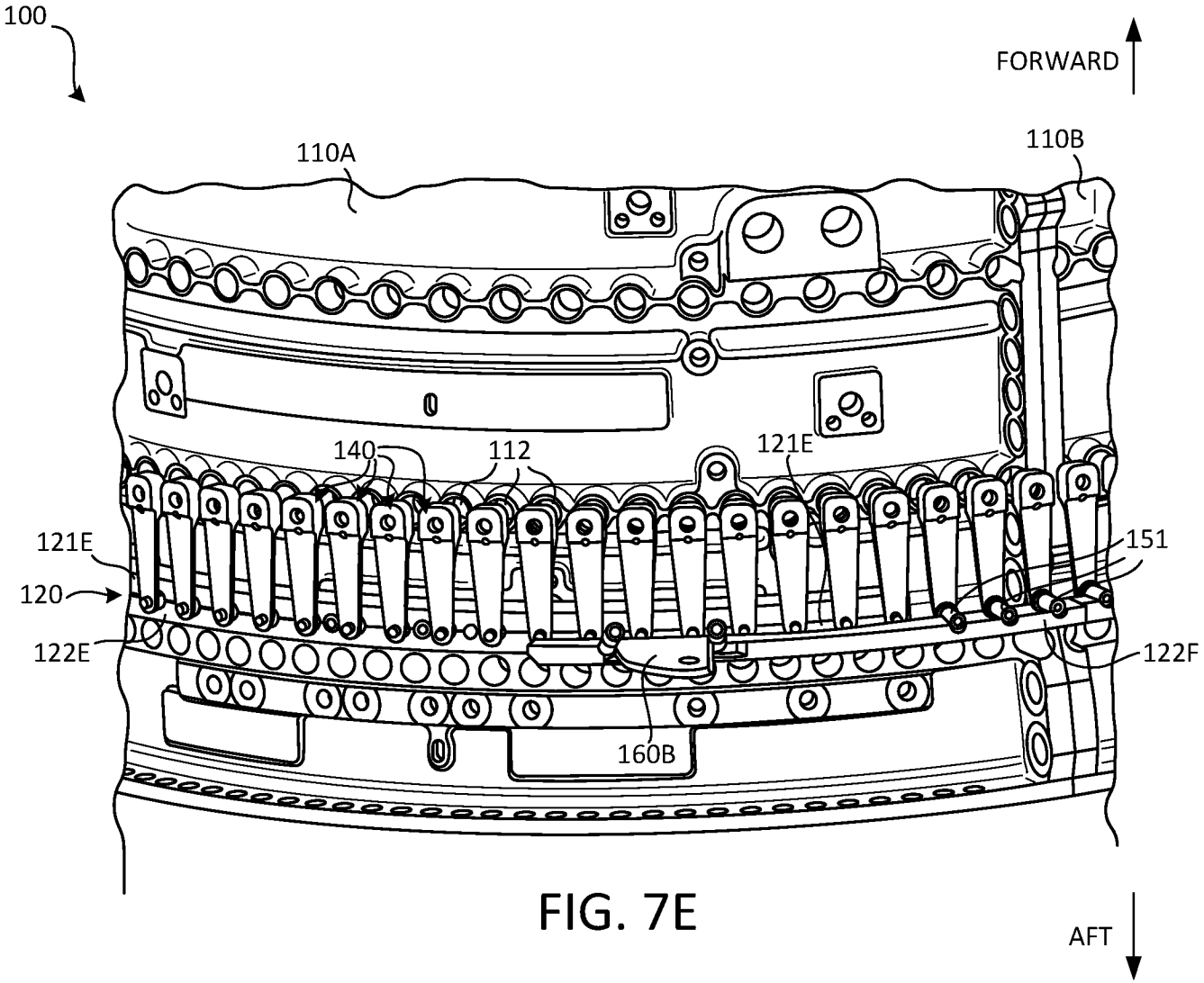
Figure 7F:
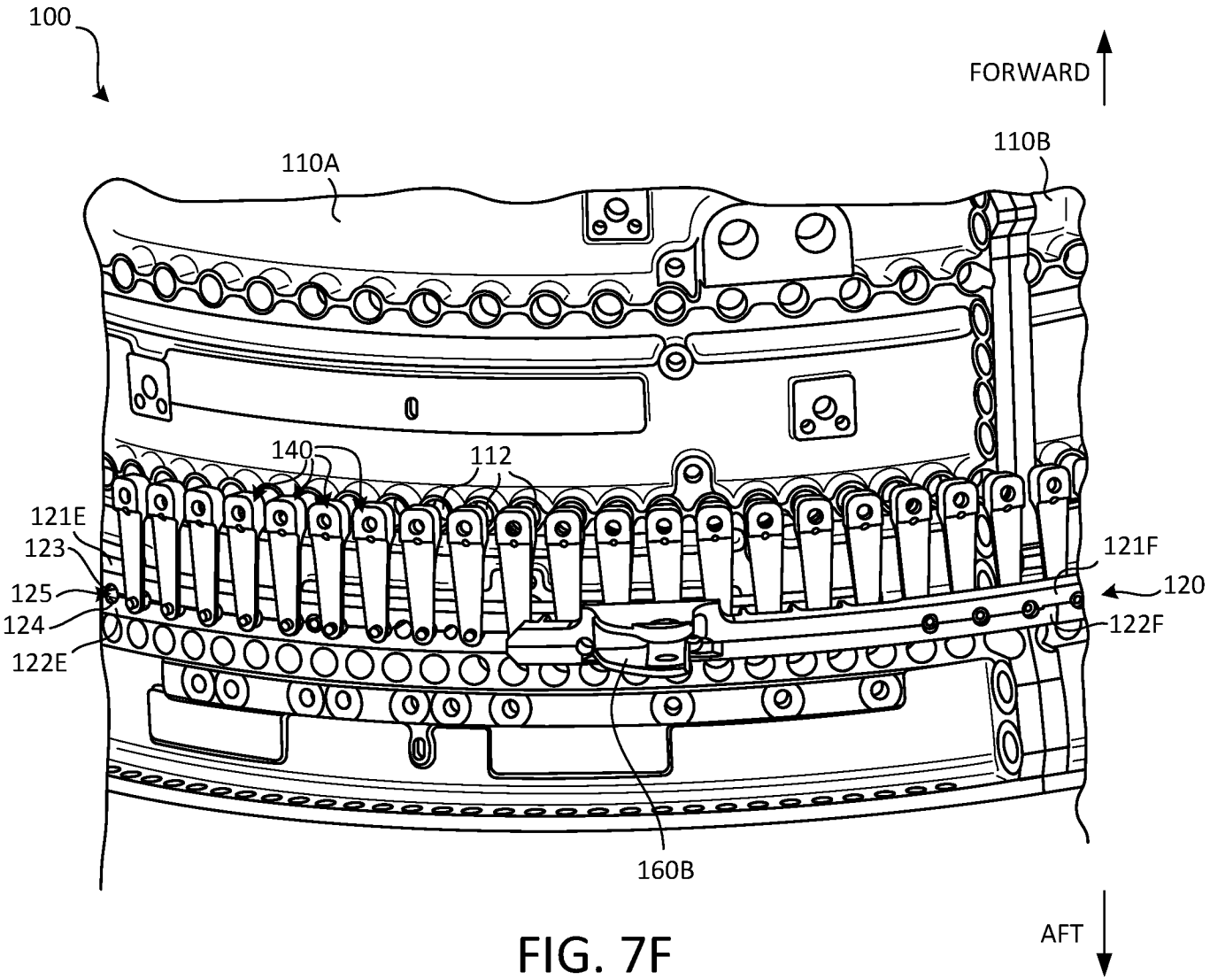

In various embodiments, and with reference to FIGS. 7E and 7F, the method 690 may include coupling a first section of the case 110A to a second section of the case 110B. Said differently, the case 110 may be formed in two halves, and thus vane stems 134 of the vanes may be inserted through the vane stem slots 112 while the two halves 110A, 110B of the case 110 are separate. After the vanes are coupled to the vane arms 140, the halves 110A, 110B of the case may be coupled together. In various embodiments, the method 690 further includes individually removing a vane to be replaced or repaired. Individually removing the vane includes decoupling at least a local arcuate segment of the aft ring portion from the first ring portion and decoupling the first end of the vane arm from the radially outward end of the vane stem via relative axial movement between the vane arm and the radially outward end of the vane stem, according to various embodiments.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A synchronization ring for a variable vane assembly of a gas turbine engine, the synchronization ring comprising:

a first ring portion, wherein the first ring portion defines a plurality of first semi-cylindrical bores circumferentially distributed around the first ring portion and extending radially through the first ring portion; and a second ring portion, wherein the second ring portion defines a plurality of second semi-cylindrical bores circumferentially distributed around the second ring portion and extending radially through the second ring portion;

wherein the first ring portion and the second ring portion are detachably coupled together such that the plurality of first semi-cylindrical bores are circumferentially aligned with the plurality of second semi-cylindrical bores to jointly define a plurality of cylindrical bores circumferentially distributed around the synchronization ring and extending radially through the synchronization ring;

wherein the first ring portion comprises a plurality of first arcuate segments circumferentially coupled together;

wherein the second ring portion comprises a plurality of second arcuate segments circumferentially coupled together; and wherein the plurality of first arcuate segments comprises a first quantity of arcuate segments and the plurality of second arcuate segments comprises a second quantity of arcuate segments, wherein the first quantity is different than the second quantity.

2. The synchronization ring of claim 1, wherein a first interface between first adjacent arcuate segments of the plurality of first arcuate segments is circumferentially misaligned with a second interface between second adjacent arcuate segments of the plurality of second arcuate segments.

3. The synchronization ring of claim 1, wherein the first ring portion is a forward ring portion and the second ring portion is an aft ring portion.

4. The synchronization ring of claim 3, wherein the first quantity of arcuate segments is less than the second quantity of arcuate segments.

5. A gas turbine engine comprising:

a compressor case; and a synchronization ring disposed radially outward of the compressor case and configured to circumferentially rotate relative to the compressor case, the synchronization ring comprising a forward ring portion and an aft ring portion detachably coupled together, wherein the forward ring portion and the aft ring portion jointly define a plurality of cylindrical bores circumferentially distributed around the synchronization ring and extending radially through the synchronization ring.

6. The gas turbine engine of claim 5, wherein the compressor case defines a plurality of vane stem slots circumferentially distributed around the compressor case and extending radially through the compressor case, wherein the gas turbine engine further comprises:

a vane comprising a vane body and a vane stem, wherein the vane body is disposed on a radially inward side of the compressor case and the vane stem extends radially outward through one of the plurality of vane stem slots;

a vane arm comprising a first end and a second end, wherein the first end is coupled to a radially outward end of the vane stem, the vane arm extending substantially perpendicular to the vane stem; and a pin coupled to the second end of the vane arm, the pin extending radially;

wherein the pin extends radially through one of the plurality of cylindrical bores.

7. The gas turbine engine of claim 6, wherein the first end of the vane arm comprises a dovetail-type cavity, and wherein the radially outward end of the vane stem comprises a complementary dovetail-type protrusion.

8. The gas turbine engine of claim 6, wherein the pin is at least one of rotatably coupled to the second end of the vane arm or rotatable within the one of the plurality of cylindrical bores.

9. The gas turbine engine of claim 6, wherein:

the vane is a first vane, the vane body is a first vane body, the vane stem is a first vane stem, the radially outward end is a first radially outward end, the vane arm is a first vane arm, and the pin is a first pin; and the gas turbine engine further comprises:

a second vane comprising a second vane body and a second vane stem, wherein the second vane body is disposed on a radially inward side of the compressor case and the second vane stem extends radially outward through one of the plurality of vane stem slots;

a second vane arm comprising a third end and a fourth end, wherein the third end is coupled to a second radially outward end of the second vane stem, the second vane arm extending substantially perpendicular to the second vane stem; and a second pin coupled to the fourth end of the second vane arm, the second pin extending radially, wherein the second pin extends radially through one of the plurality of cylindrical bores.

10. The gas turbine engine of claim 9, wherein the first pin extends radially inward from the second end of the first vane arm and the second pin extends radially outward from the fourth end of the second vane arm.

11. A method of assembling a gas turbine engine, the method comprising:

inserting a vane stem of a vane radially outward through a vane stem slot of a compressor case;

coupling a first end of a vane arm to a radially outward end of the vane stem, wherein a pin is coupled to a second end of the vane arm;

positioning a forward ring portion of a synchronization ring forward of the pin;

positioning an aft ring portion of the synchronization ring aft of the pin;

coupling the forward ring portion to the aft ring portion, wherein the forward ring portion and the aft ring portion jointly define a cylindrical bore around the pin.

12. The method of claim 11, wherein coupling the first end of the vane arm to the radially outward end of the vane stem comprises relative axial movement between the vane arm and the radially outward end of the vane stem.

13. The method of claim 12, wherein the first end of the vane arm comprises a dovetail-type cavity, wherein the radially outward end of the vane stem comprises a complementary dovetail-type protrusion, and wherein coupling the first end of the vane arm to the radially outward end of the vane stem comprises axially inserting the dovetail-type protrusion into the dovetail-type cavity.

14. The method of claim 12, further comprising individually removing the vane for at least one of replacement or repair, wherein individually removing the vane comprises:

decoupling a local arcuate segment of the aft ring portion from the forward ring portion; and decoupling the first end of the vane arm from the radially outward end of the vane stem via relative axial movement between the vane arm and the radially outward end of the vane stem.

* * * * *